United States Patent [19]

Focke et al.

[11] 4,193,534

[45] Mar. 18, 1980

[54] FOLDABLE BLANKS AND STRIPS FOR THE PRODUCTION OF FLIP-TOP CIGARETTE BOXES

[75] Inventors: Heinz Focke; Kurt Liedtke, both of Verden, Fed. Rep. of Germany

[73] Assignee: Focke & Co., Verden, Fed. Rep. of Germany

[21] Appl. No.: 961,074

[22] Filed: Nov. 15, 1978

[30] Foreign Application Priority Data

Dec. 22, 1977 [DE] Fed. Rep. of Germany ..... 2757251

[51] Int. Cl.[2] ..... B65D 5/34

[52] U.S. Cl. ..... 229/44 CB

[58] Field of Search ..... 229/44 CB, 16 A

[56] References Cited

U.S. PATENT DOCUMENTS 3,979,047 9/1976 Focke et al. ..... 229/44 CB 4,114,777 9/1978 Frohling et al. ..... 229/44 CB 4,121,756 10/1978 Focke et al. ..... 229/44 CB

FOREIGN PATENT DOCUMENTS 2642708 9/1976 Fed. Rep. of Germany ..... 229/44 CB

*Primary Examiner*—Davis T. Moorhead

*Attorney, Agent, or Firm*—Sughrue, Rothwell, Mion, Zinn and Macpeak

[57] ABSTRACT

The side edges of a blank from which a flip-top cigarette box may be folded have elongated recesses or toothed configuarations formed by various side flap portions of narrow and full width. Adjacent lines of blanks on a strip of packaging material are disposed in opposite directions and longitudinally offset or displaced with their side edges matingly interleaved, to thereby minimize material waste.

20 Claims, 6 Drawing Figures

62
36
36
27
13
28
24
25
45
37
15
38
46
47
47
41
42
23
14
29
30
43
44
31
20
32
25
60
39
19
40
33
18
34
35
50
26
62
35
48
50
49

50
26
50
33
18
34
35
25
39
19
40
31
20
32
51
52
29
30
24
25
53
54
53
37
15
38
23
27
13
28
23
36

FOLDABLE BLANKS AND STRIPS FOR THE PRODUCTION OF FLIP-TOP CIGARETTE BOXES

BACKGROUND OF THE INVENTION

This invention relates to a blank for the production of a rectangular folding box, particularly for cigarettes. The blank has a main portion comprising surface areas separated from each other by fold lines for the front, floor and back walls, as well as areas successively connected to the rear wall for the lid back, ceiling and front walls. Main and lid side flaps are also provided to form main and lid side walls by their overlapped folding. The invention also relates to a folding box manufactured from such a blank, as well as to a strip of packaging material for the production of the blanks.

The folding boxes here concerned are mainly intended to contain cigarettes, cigarillos, etc. The basic structure of the box is rectangular with a folding lid hinged to the back wall of the main box body. A collar is disposed in the opening of the box, a portion of which collar projects out of the box and is surrounded by the front and side areas of the lid when the box is closed. The relatively expensive construction of packages of this type requires a correspondingly complex and expensive material blank, such a hard paper, cardboard or the like.

SUMMARY OF THE INVENTION

A primary object of this invention is to provide blanks for flip-top cigarette boxes in such a manner as to reduce the material expense while only slightly modifying the outer appearance and configuration of the box.

To achieve this object the blank according to the invention is characterized in that a portion of the inner lid side flap connected to the back wall of the main box portion, the inner lid side flaps and the lid corner flaps have a total length which corresponds to the length of the outer side flaps connected to the front wall of the main box portion, while having a narrower width than said outer side flaps.

The invention proceeds from the realization that material savings can only be achieved in those areas where conventional boxes are formed with two layers, typically overlapping inner and outer side flaps. That is, since the full width of the outer side flaps of the main box and lid portions must be maintained to preserve the appearance and configuration of the box, material savings can only be realized by reducing the areas of the "underlapping" or inner side flaps.

According to the invention the blanks are laid out in longitudinal lines on a sheet of packaging material with adjacent lines being oriented in opposite or reversed directions. This enables the full width side flap portions of one blank to mate or interleave with the narrow width side flap portions of an adjacent blank. A gap or recess is also formed between successive blanks in a given line, and this recess is occupied by the full width outer lid side flap of a blank in the adjacent line.

In the resulting box folded from the blank the floor and lid corner flaps are sandwiched between the partially overlapping side flaps of the main box and lid portions.

DETAILED DESCRIPTION OF THE PREFERRED EMBODIMENTS

Figure 1:
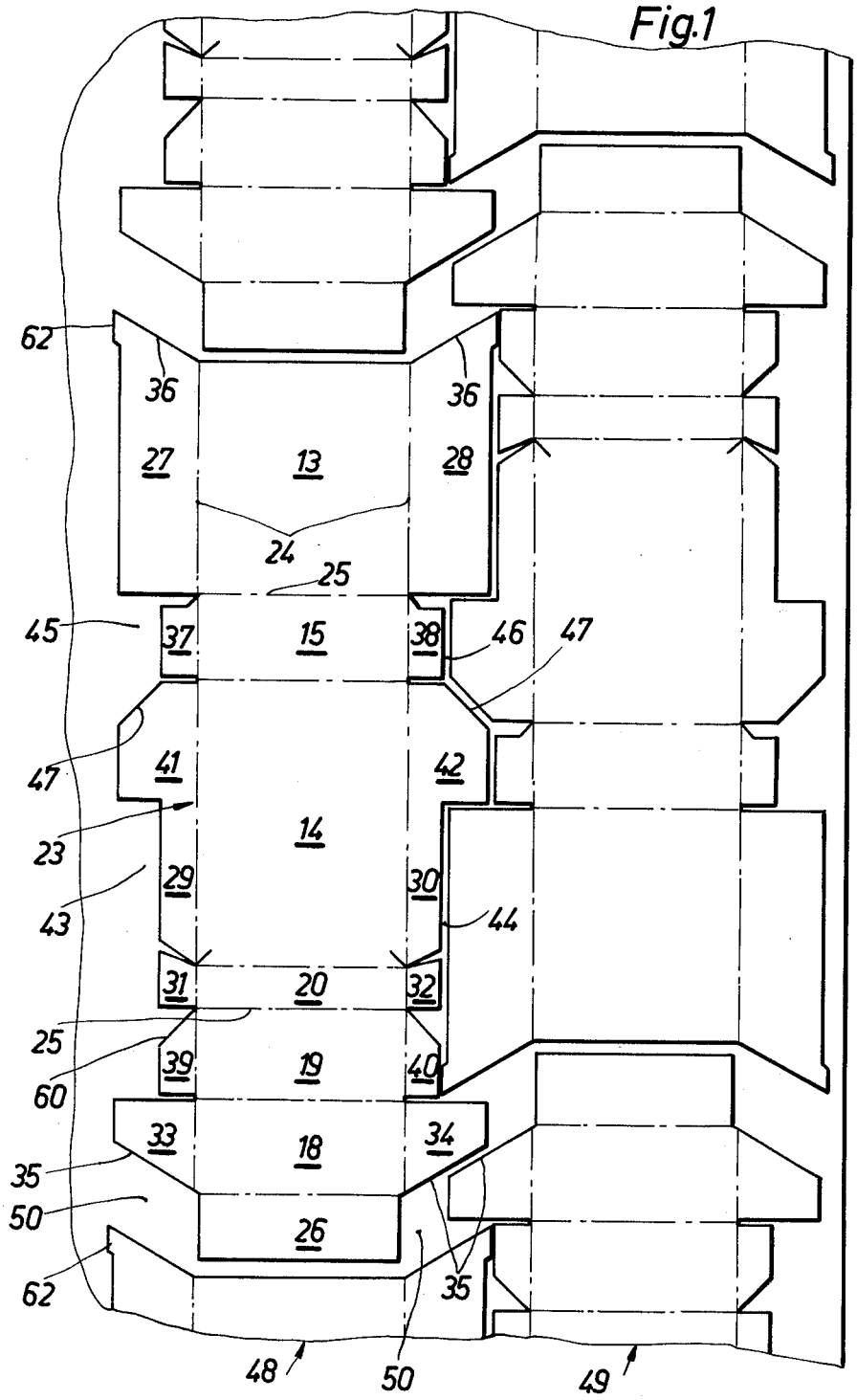
FIG. 1 shows a plan view of a sheet of packaging material with adjacent lines of blanks laid out thereon according to the invention.

Referring now to the drawings, all embodiments comprise a main box portion 10 and a folding lid 11 hingedly connected thereto, with a collar 12 extending upwardly out of the open top of the main box portion. In the closed position of the box the collar 12 is surrounded by the front and sides of the lid.

Each blank comprises, in longitudinal succession, a front wall 13, a floor wall 15, a back wall 14, a lid back wall 20, a lid ceiling wall 19, a lid front wall 18, and a lid inner flap 26. The main box portion side walls are designated by reference numerals 16 and 17, and the lid side walls by 21 and 22. The back wall 20 of the lid is hinged to the upper edge of the back wall 14 of the main box portion, in a conventional manner.

Each elongated blank 23 is sub-divided into its various surface areas by longitudinal fold lines 24 and transverse fold lines 25. The inner flap 26 of the lid is folded inwardly against the inside of the lid front wall 18 to provide rigidity to the lid.

Full width outer side flaps 27 and 28 are connected to the front wall 13 of the main box portion, and form the outer layers of the side walls 16 and 17 in the finished box. Inner side flaps 29 and 30 are connected to the back wall 14, and are secured to the outer side flaps 27, 28 by glueing or the like.

Figure 3:
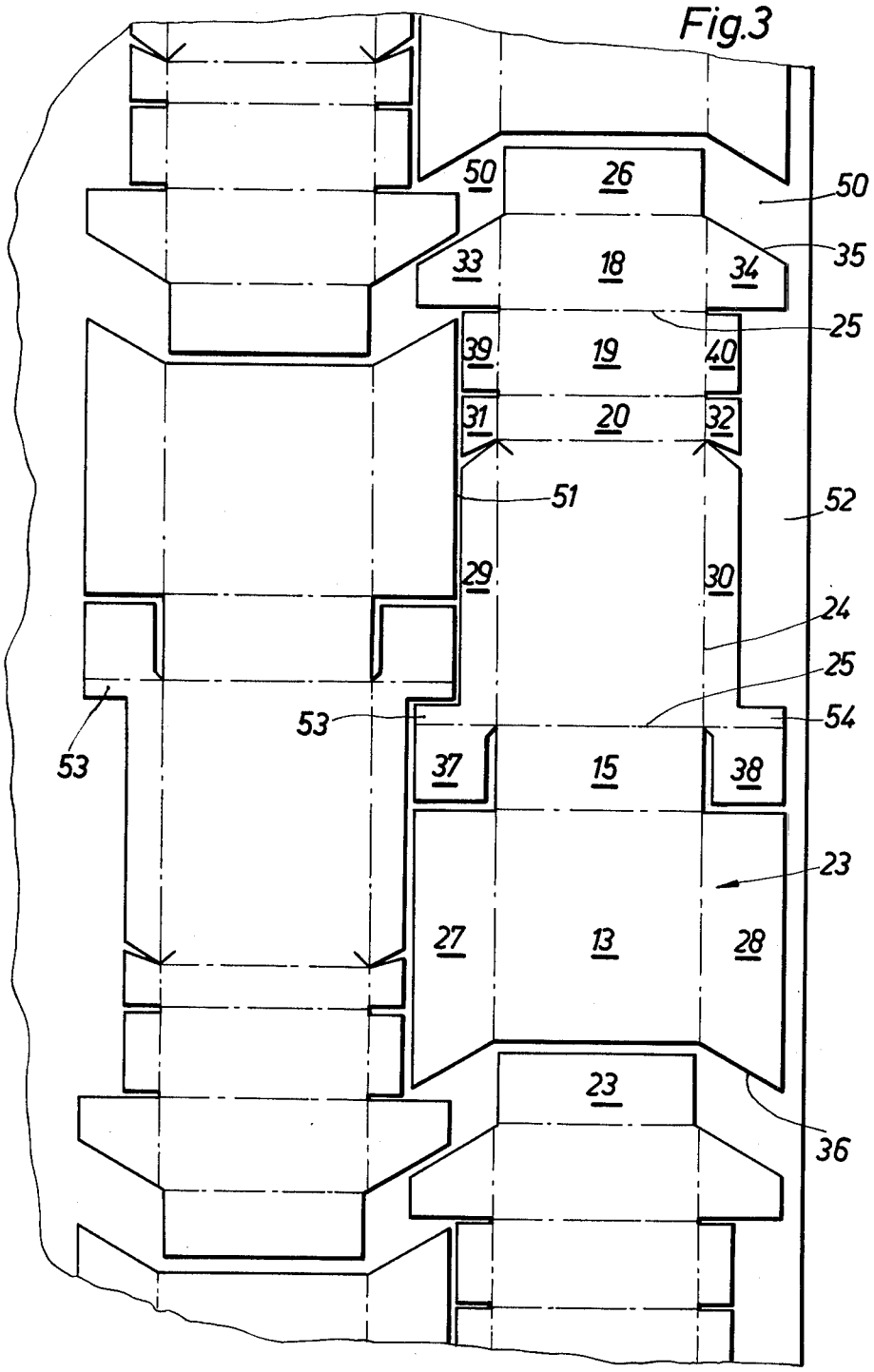
FIGS. 3 and 5 show respective plan views of blank layouts according to further embodiments of the invention.
Figure 5:
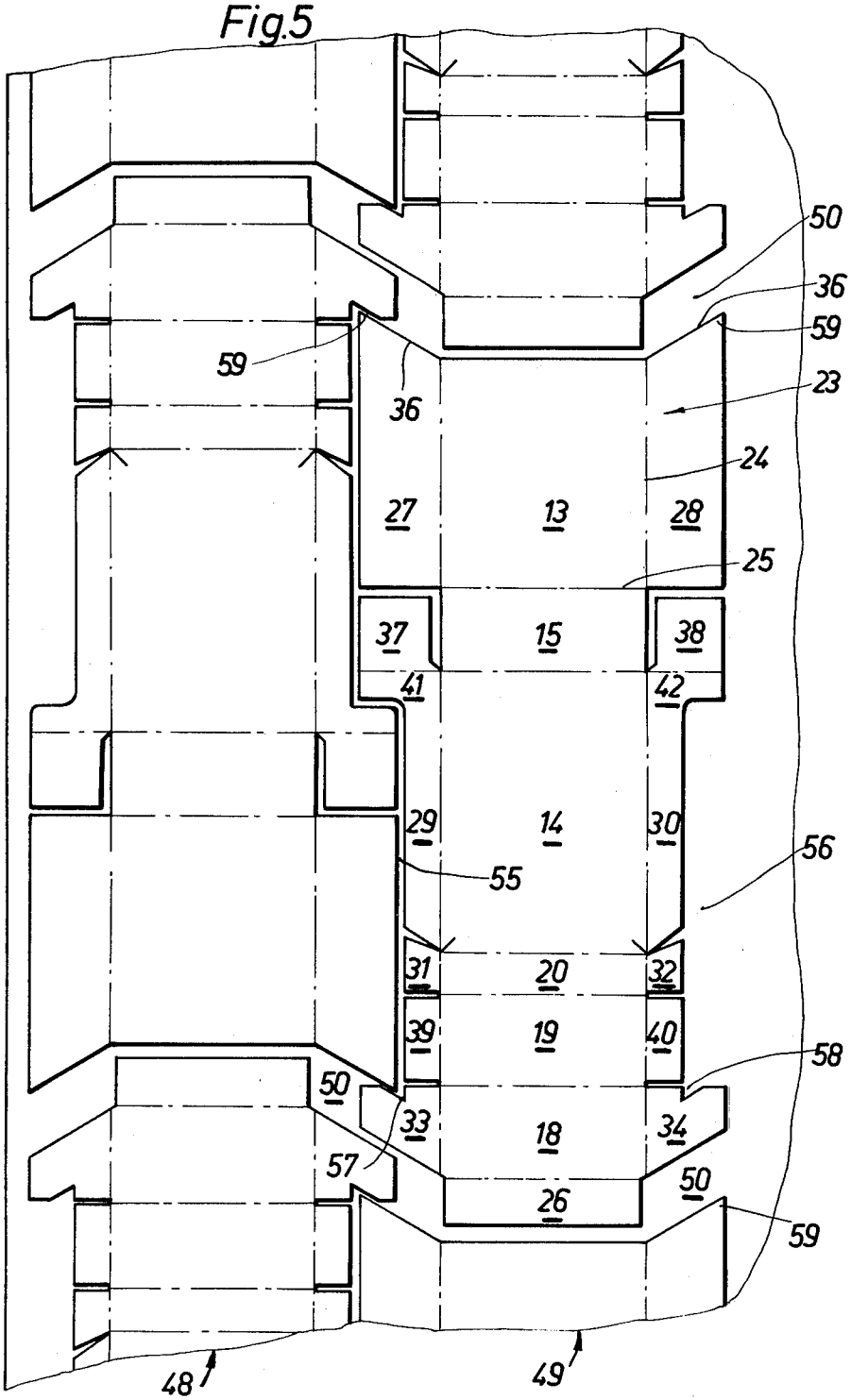

The lid is formed in an analogous manner, with inner lid side flaps 31 and 32 of narrow width connected to the lid back wall 20, and full width outer lid side flaps 33 and 34 being connected to the lid front wall 18. The flaps 33, 34 have an angled closing edge 35 which is parallel to the closing edge 36 of the outer side flaps 27, 28. The other elements of the blank include floor corner flaps 37, 38 and lid corner flaps 39, 40, all of narrow or reduced width. In the embodiment of FIGS. 3 and 5 the floor corner flaps 37, 38 are not connected directly to the main blank portion as in FIG. 1, but instead depend from the inner side flaps 29, 30.

In all embodiments the contiguous narrow width inner side flaps form longitudinal cut-outs or recesses which accommodate full width outer side flaps in the adjacent line of blanks, thus reducing the overall width of two adjacent lines of blanks and enabling considerable material economy.

In the embodiment of FIG. 1 the inner side flaps 29, 30 of the main box portion have a narrow width over part of their lengths and full width end elements 41, 42 adjacent the floor wall 15. These end elements serve as supporting and guiding members in the finished box and act as stops during the folding of the front wall 13 to ensure the desired rectangular configuration of the box. They also stabilize the box in the area of the lower or floor portion.

The narrow widths of the inner lid side flaps 31, 32 and the lid corner flaps 39, 40 result in elongated recesses 43, 44 along the opposite sides of each blank, and the length of these recesses corresponds to the length of the outer side flaps 27, 28. The narrow width floor corner flaps 37, 38 also produce side recesses 45, 46, whose shape is trapezoidal due to the angled edges 47 of the adjacent end elements 41, 42.

This overall side flap configuration of each blank enables an interleaved or interlocking lay-out of adjacent lines of blanks 48, 49 with each line reversed in direction relative to an adjacent line and longitudinally displaced therefrom. Thus, the wide outer side flaps 27, 28 of one line fit into the recesses 43, 44 of an adjacent line, and the wide trapezoidal end elements 41, 42 of one line fit into the recesses 45, 46 of the neighboring lines. In addition, the wide outer lid side flaps 33, 34 are accommodated in side gaps 50 formed between successive blanks in each row. The angled closing edges 35 of the lid side flaps in adjacent lines thus lie parallel to and just opposite each other.

Figure 4:
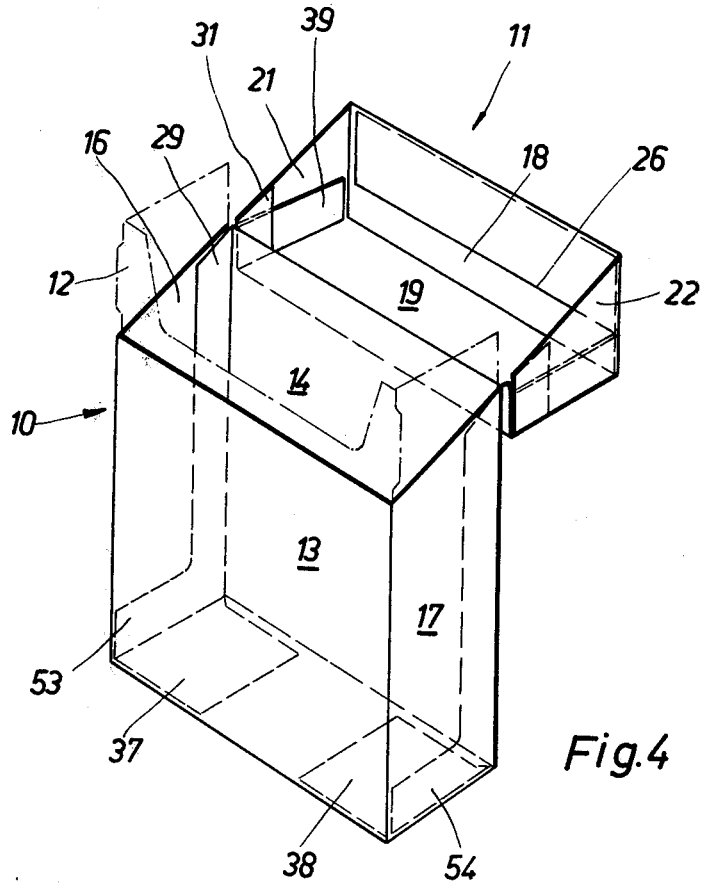
FIGS. 4 and 6 show perspective views of boxes folded from the blanks of FIGS. 3 and 5, respectively, with the lid being closed in FIG. 6.

In the embodiment of FIGS. 3–4 the blanks are provided with elongated recesses 51, 52 on opposite sides, which extend through most of the inner side flaps 29, 30 and over all of the inner lid side flaps 31, 32 and the lid corner flaps 39, 40. Small rectangular end elements 53, 54 of short length but full width thus remain on the lower ends of the inner side flaps, and the floor corner flaps 37, 38 are directly connected to these end elements. The lengths of the recesses 51, 52 in one line of blanks thus accommodate the full width outer side flaps 27, 28 together with the corner flaps 37, 38 and the end elements 53, 54 in the adjacent line of blanks. The full width outer lid side flaps 33, 34 fit into the gaps 50 between successive blanks in a line, as in the previous embodiment.

Figure 6:
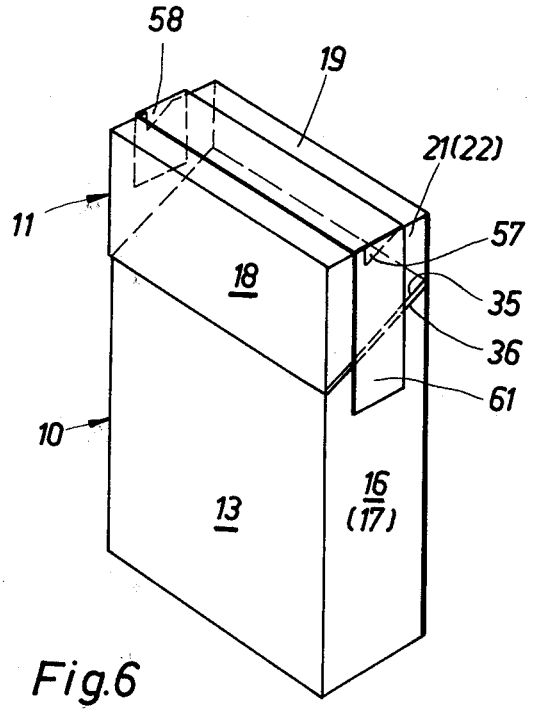

In the embodiment of FIGS. 5–6 elongated recesses 55, 56 are provided on opposite sides of each blank, and generally correspond to the recesses 51, 52 in the previous embodiment. Here, however, a sharp triangular extension of the recesses 55, 56 is provided in the form of notches or cut-outs 57, 58 in the outer lid side flaps 33, 34. The interleaving between adjacent lines of blanks is generally the same as in the previous embodiment, but here pointed tips 59 formed by the angled closing edges 36 of the side flaps 27, 28 fit into the notches 57, 58. This enables a shortening of the inner lid flaps 26, and attendant reduction in the length of each gap 50 between successive blanks in a line, and consequent additional material savings.

Figure 2:
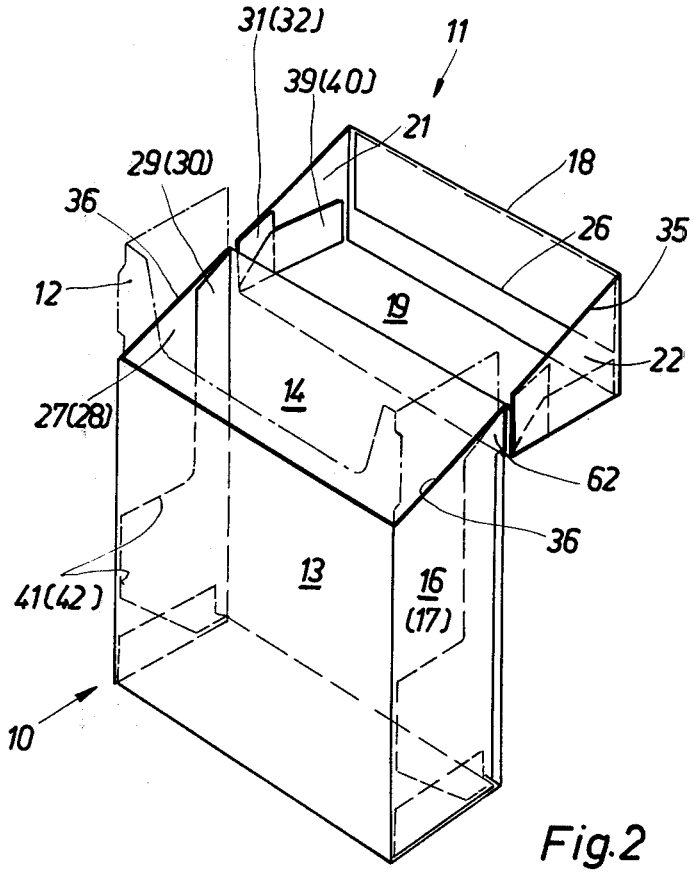
FIG. 2 shows a perspective view of a flip-top box folded from a blank of FIG. 1 with the lid open.

In the embodiment of FIGS. 1–2 the floor corner flaps 37, 38 are sandwiched between the outer side flaps 27, 28 and the inner side flaps 29, 30. This assures that when a blank is only partially folded with the inner side flaps 29, 30 erected in a parallel manner, the box contents (a block of cigarettes) can be inserted into the box in a longitudinal direction without hinderance from the free edges of the floor corner flaps 37, 38.

In the folding of the lid portion 11, the inner lid side flaps 31, 32 preferably bear directly against the outer lid side flaps 33, 34, while a portion of the lid corner flaps 39, 40 lies against the inner lid side flaps and the remainder lies against the outer lid side flaps. The lid corner flaps 39, 40 are provided with a sharply angled edge 60 in order to decrease the three layered areas of the lid side walls.

In the embodiments of FIGS. 3–6 the floor corner flaps 37, 38 are folded against the inside of the floor wall 15. In the lids the full length rectangular lid corner flaps 39, 40 bear directly against the inner surfaces of the outer side flaps 33, 34, with the lid side flaps 31, 32 lying entirely on the inside of the box.

In the embodiment of FIGS. 5–6 the notches 57, 58 in the outer lid side flaps 33, 34 produce corresponding recesses in the outer surface of each lid side wall in the folded box. These recesses are covered over by a sealing strip 61 in the form of a tax stamp or the like.

The depth of the various side edge recesses should be chosen to maximize material savings while at the same time leaving sufficient side flap contact or overlap surfaces to ensure a firm and rigid box construction. When the box and lid side walls have a width of 22.5 mm, for example, the narrow side flap portions of each blank can have a width of about 9–10 mm and still be effective for both purposes.

Blanks of the type described above can be advantageously and effectively handled in a packaging machine of the type disclosed in German DTOS 2440006, which involves a folding mechanism of the revolving turret type. The blanks can be individually guided into pockets of the turret which implements their partial folding into a U-shaped configuration. In the successive work stations of the turret each blank is then radially loaded with a group of cigarettes and further folded.

A unique feature of the embodiment of FIGS. 1–2 relates to the provision of means for maintaining the rectangular shape of the box during its folding until glue can be applied to the various overlapping side flaps. Specifically, the parallel opposite walls of the blank must be held parallel to each other during folding and glueing, which is hampered by the fact that the inner side flaps 29, 30 have reduced width portions and thus do not provide full area support surfaces. This problem is solved in the embodiment of FIGS. 1–2 by the provision of support extensions 62 on the upper rear corners of the outer side flaps 27, 28. The dimensions of these support extensions 62 are chosen so that they lie at the extreme corner edges of the box, whereby when a partially folded blank lies on a conveyor of a packaging machine it is supported by the extensions 62. The inner and outer side flaps are therefore prevented from sliding against each other in an undesirable manner. The provision of the extensions 62 is enabled in that an opening or space is generally formed between adjacent blanks on a sheet of packaging material to enable appropriate separating cuts to be made. This space is thus briefly bridged by the support extensions 62.

This type of folding support can also be provided by forming the collar 12 with dimensions such that the three side edges of the collar side flaps are supported on the inside of the back wall 14 of the boxes. The collar side flaps are thus made somewhat wider than in conventional boxes of this type.

What is claimed is:

1. A material blank from which a rectangular box of the hinged lid or flip-top type may be folded, said blank including longitudinally successive surface areas defined by fold lines and comprising front, floor and back walls of a main box portion and back, ceiling and front walls of a hinged lid, and laterally projecting side flaps, lid side flaps, floor corner flaps and lid corner flaps adapted to form main box portion side walls and lid side walls by their overlapped folding, characterized by: a portion of inner side flaps (29,30) connected to the back wall (14) and directed toward the lid (11), inner lid side flaps (31,32) connected to the sides of the back lid wall (20) and lid corner flaps (39,40) connected to the upper lid wall (19) having a total length at least as great as the length of outer side flaps (27,28) connected to the front wall (13), and a narrower width than the outer side flaps (27,28) and lid side flaps (33,34), and wherein end elements (41, 42;53,54) of the inner side flaps (29,30) directed toward the floor wall (15) have the same width as the box side walls (16,17).

2. Blank according to claim 1, wherein floor corner flaps (37,38) adjacent the floor wall (15) have a narrower width than the adjacent end elements (41,42).

3. Blank according to claim 1, wherein the end elements (41,42) directed toward floor corner flaps (37,38) are formed with angled corner edges (47).

4. Blank according to claim 3, wherein the cross-sectional decrease of the blank at recesses (51,52) formed by the inner side flaps (29,30), lid side flaps (31,32) and lid corner flaps (39,40) has a length which corresponds to the length of the outer side flaps (27,28) in addition to the length of the floor corner flaps (37,38) and end element portions (53,54) of the inner side flaps (29,30).

5. Blank according to claim 4, wherein the floor corner flaps (37,38) are joined to the end elements (53,54) of the inner side flaps.

6. Blank according to claim 5, wherein the cross-sectional decrease at recesses (55,56) extends into triangular notches in the outer lid side flaps (33,34).

7. A strip of packaging material of paper, cardboard, or the like for the production of blanks according to claim 1, wherein the blanks are arranged in lines such that the wide areas of one line fit into side recesses formed by decreased width portions of blanks in the adjacent line, characterized by: the outer full-width side flaps (27,28) of a blank projecting into a side recess (43,44) of a blank in the adjacent line (48,49) formed in a portion of the inner side flaps (29,30) by the inner lid side flaps (33,34) and by the lid corner flaps (39,40).

8. Strip according to claim 7, wherein end elements (41,42) of the inner side flaps (29,30) project at least partially into side recesses (45,46) formed by narrow width floor corner flaps (37,38).

9. Strip according to claim 8, wherein the end elements (41, 42) are shaped as trapezoids by angled edges (47) and project into corresponding shaped recesses (45, 46).

10. Strip according to claim 9, wherein side recesses (51, 52) have lengths such that the outer side flaps (27, 28), the floor corner flaps (37, 38) and end elements (53, 54) are received by concerned recesses (51, 52) of a blank in the adjacent line.

11. Strip according to claim 10, wherein a point (59) formed by an angled closing edge (36) of an outer side flap (27, 28) projects into a recess (57, 58) in the outer lid side flap (33, 34) of a blank in the adjacent line.

12. Strip according to claim 11, wherein an outer flap (33, 34) joined to the lid front wall (18) is arranged between successive blanks in a line.

13. Strip according to claim 12, wherein a wide area of a blank of one line projects into a gap (50) between successive blanks in the adjacent line.

14. Strip according to claim 13, wherein the outer lid side flaps (33, 34) project into the gap (50) between the outer side flaps (27, 28) of a blank and the outer lid side flaps (33, 34) of a following blank in the adjacent line.

15. A box made from a blank according to claim 1, characterized in that floor corner flaps (37, 38) joined directly to the floor wall (15) are arranged between the outer side flaps (27, 28) and inner side flaps (29, 30) end elements (41, 42).

16. Box according to claim 15, wherein lid corner flaps (39, 40) formed with angled edges (60) are arranged between the inner lid side flaps (31, 32) and the outer lid side flaps (33, 34).

17. Box according to claim 15, wherein the inner lid side flaps (31, 32) are arranged between the outer lid side flaps (33, 34) and rectangular lid corner flaps (39, 40).

18. Box according to claim 15, wherein recesses (57, 58) formed in the outer lid side flaps (33, 34) are covered by a sealing strip (51).

19. Box according to claim 15, wherein the outer side flaps (27, 28) are provided with support extensions (62) which extend to the outer border of the side walls (16, 17) in the vicinity of decreased widths of the inner side flaps (29, 30).

20. Box according to claim 19, wherein the support extensions (62) are arranged on the upper rear side edges of the side flaps (27, 28).

* * * * *